US010618695B2

(12) United States Patent
McCormick

(10) Patent No.: US 10,618,695 B2
(45) Date of Patent: Apr. 14, 2020

(54) CONTENTS RACK FOR USE IN INSULATED STORAGE CONTAINERS

(71) Applicant: Savsu Technologies LLC, Old Bethpage, NY (US)

(72) Inventor: Bruce McCormick, Santa Fe, NM (US)

(73) Assignee: SAVSU TECHNOLOGIES LLC, Old Bethpage, NY (US)

( * ) Notice: Subject to any disclaimer, the term of this patent is extended or adjusted under 35 U.S.C. 154(b) by 1241 days.

(21) Appl. No.: 14/081,402

(22) Filed: Nov. 15, 2013

(65) Prior Publication Data

US 2014/0138392 A1 May 22, 2014

Related U.S. Application Data

(60) Provisional application No. 61/727,471, filed on Nov. 16, 2012.

(51) Int. Cl.
*B65D 25/10* (2006.01)
*B65D 81/38* (2006.01)

(52) U.S. Cl.
CPC ..... *B65D 25/10* (2013.01); *B65D 81/3813* (2013.01)

(58) Field of Classification Search
CPC ..... F25D 2303/0841; A45C 13/02; A45C 2013/026; B65D 25/10; B65D 81/07; B65D 81/3813
See application file for complete search history.

(56) References Cited

U.S. PATENT DOCUMENTS 3,810,367 A * 5/1974 Peterson ..... F25D 3/00 220/771
3,974,658 A * 8/1976 Starrett ..... B65D 25/02 206/427

(Continued)

FOREIGN PATENT DOCUMENTS

EP 0157751 B1 8/1989
JP 2007118972 A 5/2007

(Continued)

OTHER PUBLICATIONS

International Search Report for application No. PCT/US2013/070335, dated Feb. 3, 2014, 3 pages.

(Continued)

*Primary Examiner* — Andrew T Kirsch
(74) *Attorney, Agent, or Firm* — Reising Ethington P.C.

(57) ABSTRACT

A thermal storage system for storing or transporting temperature-sensitive contents such as biological or pharmaceutical materials includes a thermally insulated storage container and a contents rack. The contents rack is configured to interact with one or more walls of the insulated storage container to stabilize the contents container at a desired position in the storage container. A contents sleeve and/or contents stabilizers may interact with one or more walls of the storage container. Contents stabilizers may be thermally conductive to provide conductive thermal communication between the stored contents and a phase change material in the storage container located away from the stored contents. The contents rack helps maintain the position of the contents within the storage container as the phase change material changes phase.

20 Claims, 3 Drawing Sheets

(56) References Cited

U.S. PATENT DOCUMENTS

| | | | | |
|---|---|---|---|---|
| 5,101,642 | A * | 4/1992 | Alexandrov | B65D 71/36 206/427 |
| 5,398,828 | A * | 3/1995 | Valyi | B29C 49/0078 215/396 |
| 5,901,571 | A * | 5/1999 | Whaley | F25D 3/08 62/457.5 |
| 5,924,302 | A | 7/1999 | Derifield | |
| 5,934,099 | A * | 8/1999 | Cook | A61J 1/165 206/570 |
| 6,062,411 | A * | 5/2000 | Garland, Jr. | F25D 3/08 193/25 FT |
| 6,467,299 | B1 * | 10/2002 | Coetzee | A61J 1/165 62/371 |
| 2008/0029526 | A1 * | 2/2008 | Campbell | A47G 23/0266 220/737 |
| 2009/0139248 | A1 * | 6/2009 | Crumlin | A45F 3/047 62/62 |

FOREIGN PATENT DOCUMENTS

| | | | |
|---|---|---|---|
| JP | 2008116165 | A | 5/2008 |
| JP | 2010116210 | A | 5/2010 |

OTHER PUBLICATIONS

Written Opinion for application No. PCT/US2013/070335, dated Feb. 3, 2014, 4 pages.

* cited by examiner

CONTENTS RACK FOR USE IN INSULATED STORAGE CONTAINERS

This application claims the benefit of U.S. Provisional Application No. 61/727,471, filed Nov. 16, 2012, the entire contents of which are hereby incorporated by reference.

TECHNICAL FIELD

The present disclosure relates generally to storage containers and methods of storing temperature sensitive items.

BACKGROUND

Certain pharmaceutical products and many biological materials are temperature sensitive, in that freezing may damage the materials, and temperatures that are too high may otherwise spoil the materials. Thus, during shipment and storage of these types of materials, they must often be maintained within a particular temperature range. One common range for such materials during shipment and/or storage is 2-8° C. With materials that are not damaged by freezing, it may be desirable to freeze the materials for storage and/or during shipment. In such cases, dry ice may be used in the storage area of a storage container to provide a storage temperature around the phase change temperature of dry ice, which is −78.5° C. Such storage containers may be active or passive. For example, a refrigerator or freezer is an active storage container and typically includes a refrigeration unit to extract heat from inside the storage container to maintain the desired storage temperature. A styrofoam cooler is an example of a passive storage container that relies on thermally insulating materials to retard heat transfer through the container walls. Passive storage containers are sometimes used with ice, dry ice, or some other type of phase change material inside the container to the maintain the storage area temperature.

SUMMARY

In accordance with one or more embodiments, a thermal storage system includes a thermally insulated storage container comprising one or more walls that together at least partially define a storage area. The thermal storage system also includes a contents rack that includes a contents sleeve shaped to have a close fit with a contents container. The contents rack is configured to interact with at least one of the container walls to help stabilize the contents container in a desired position within the storage area.

In accordance with one or more embodiments, a thermal storage system includes a thermally insulated storage container comprising one or more walls that together at least partially define a storage area. The thermal storage system also includes a contents container sized to fit within the storage area, and a metallic contents stabilizer configured to form a thermally conductive path between the contents container and phase change material located in the storage area away from the contents container.

In accordance with one or more embodiments, a contents rack for use in a thermally insulated storage container includes a contents sleeve shaped to have a close fit with a contents container, and a stabilizer extending from the contents sleeve to secure the contents sleeve in a desired position within a storage area of the storage container.

BRIEF DESCRIPTION OF THE DRAWINGS

One or more preferred exemplary embodiments of the invention will hereinafter be described in conjunction with the appended drawings, wherein like designations denote like elements, and wherein.

DETAILED DESCRIPTION

In applications where it is desirable to maintain the temperature of stored contents at the phase change temperature of a phase change material in the storage area of a storage container, physical contact between the stored contents and the phase change material may be desirable to provide a conduction path between the contents and the phase change material. For example, where it is desirable to maintain the stored contents at 0° C., the phase change temperature of wet ice (i.e., frozen water), it may be useful to have the stored contents in physical contact with the ice, as opposed to being in some other part of the storage container where convection is relied upon to maintain the contents at the phase change temperature. With dry ice, the stored contents are best maintained at −78.5° C. through physical contact with the dry ice.

When the contents are initially placed into a storage container, this may be easily accomplished by at least partially burying the contents directly in the phase change material, with the phase change material in crushed, granulated, pelletized, chipped, or chunk form (e.g., ice cubes or dry ice pellets). During storage, however, the phase change material may change from solid form to liquid or gas form and allow the contents to shift. In some cases, physical contact between the contents and the phase change material can be lost. This may particularly be the case with subliming phase change materials, such as dry ice, when the material is packaged around the contents to initially support the contents inside the storage container in a particular location and/or orientation.

A storage container with a contents rack as described below can help with temperature stability in applications where it is desirable to maintain the temperature of stored contents at the phase change temperature of the phase change material in the storage area of the container. The contents rack can be configured to maintain the original position and/or orientation of the stored contents during storage, regardless of how much of the phase change material remains in solid form, and it can help ensure a conduction path between the remaining solid or liquid phase change material and the contents.

Figure 1:
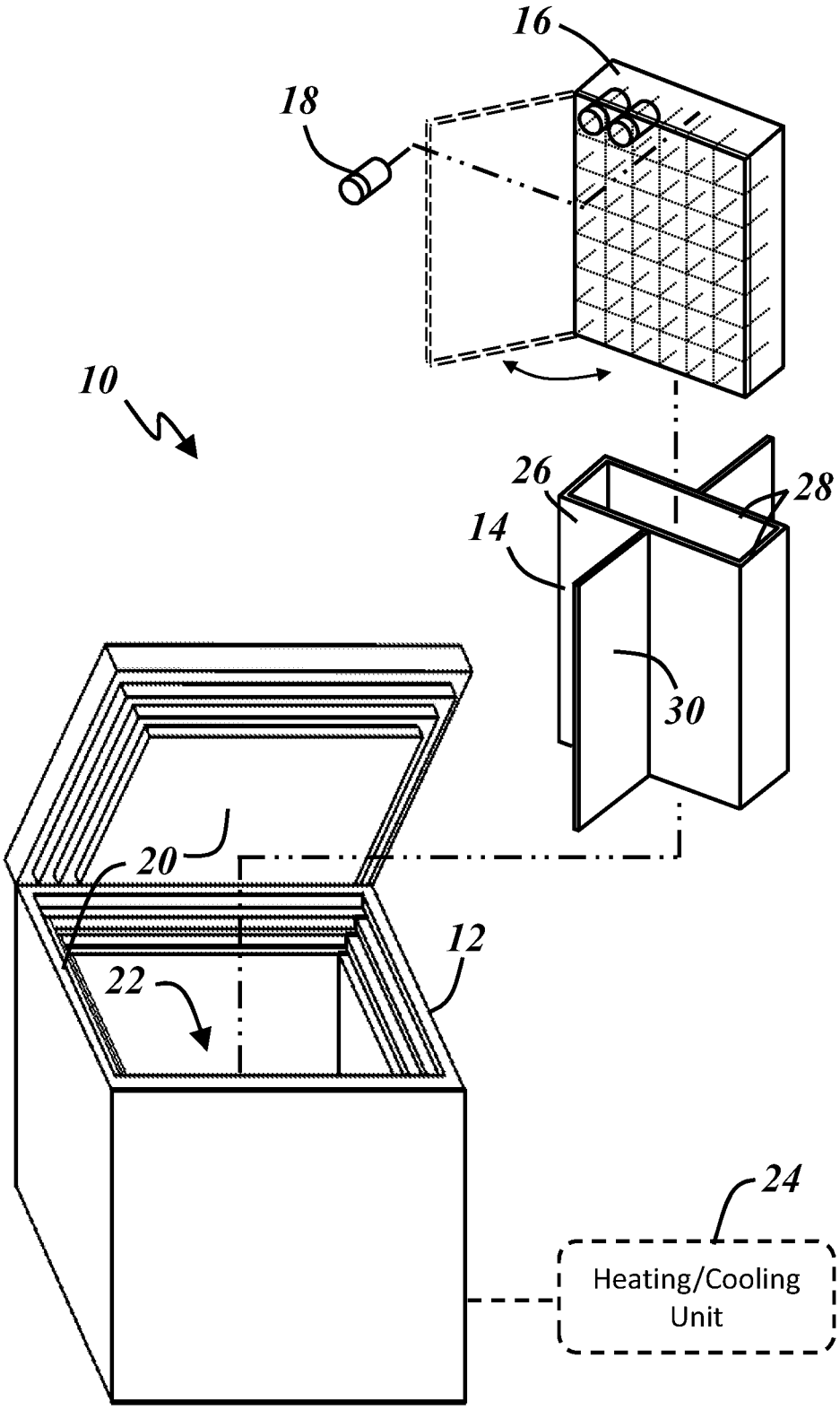
FIG. 1 is an exploded view of an embodiment of a thermal storage system, including a contents rack configured to stabilize a contents container in a thermally insulated container.

With reference to FIG. 1, there is shown an exploded view of a thermal storage system 10, including a thermally insulated storage container 12 and a contents rack 14. The illustrated embodiment also includes a contents container 16, which is configured to hold one or more vials or other smaller contents 18. The particular contents container 16 shown in FIG. 1 is a vial box, which may be used to hold several vials of biomaterials in individual compartments as shown. The vial box may be made from a thermoplastic material such as polypropylene or any other suitable material. One common vial box size is 2×4×6 inches, but other sizes are available, and the contents container 16 is not limited to this size or shape. The contents container 16 may or may not be included as part of the thermal storage system 10. For example, the system 10 may include the container 12 and the contents rack 14, with the contents rack being configured for use with separately provided contents containers, or the contents rack may be configured for use with contents 18 in the absence of a separate contents container.

The illustrated storage container 12 includes a plurality of walls 20 that together define a storage area 22 when closed. Each wall 20 may be made from or may include an insulating or super-insulating material, such as expanded polystyrene (EPS), polyurethane, aerogel, etc. The storage container may 12 be configured to hold one or more contents racks 14 and/or contents containers 16 along with ice packs, heat packs, loose phase change material, or other material designed to stabilize or otherwise affect the temperature of the storage area 22. The storage container 12 may be active or passive. An active version of the storage container includes a heating/cooling unit 24 which may include known components and arrangements of components. When unit 24 is omitted, the storage container 12 is a passive storage container.

The contents rack 14 includes a contents sleeve 26 that is shaped to have a close fit with the contents container 16. The contents container 16 fits inside and makes contact with surrounding walls 28 of the sleeve 26. Preferably the contact between the sleeve 26 and the contents container 16 is surface contact. In one embodiment, a thin liner, such as a thin plastic film, separate liner, or bag (not shown) may be placed between the contents container 16 and the contents sleeve 26 to assist with subsequent removal of the contents container from the contents sleeve. In the illustrated embodiment, the contents sleeve 26 is shaped to surround or circumscribe the contents container 16, but could also be shaped to only partially circumscribe the contents container. The contents rack 14 is configured to interact with at least one of the container walls 20 to help stabilize the contents container 16 in a desired position within the storage area 22 of the storage container 12. The desired position may include a particular location within the storage area and/or a desired orientation. In this example, the contents rack 14 includes contents stabilizers 30 to help stabilize the contents container in the desired position when placed in the storage container 12 together with sleeve 26. Each stabilizer 30 extends from the contents sleeve 26 to contact or otherwise interact with one or more of the walls 20. The interaction can include physical contact, a tongue-in-groove fit, and/or a temporary or permanent attachment, for example.

Figure 2:
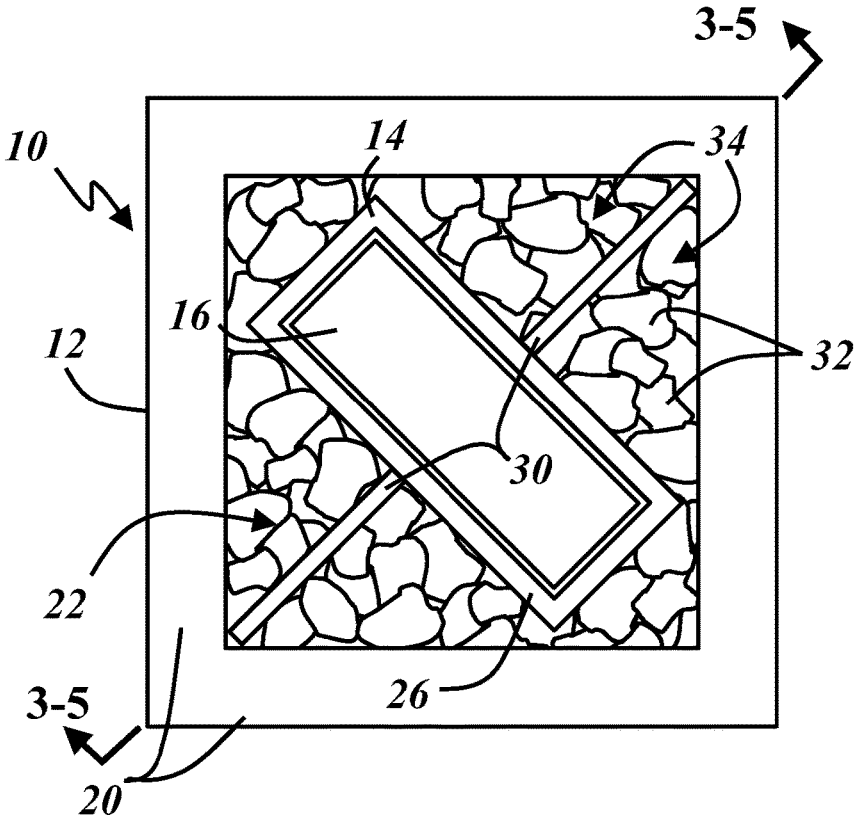
FIG. 2 is a top-view of the storage system of FIG. 1, open to show the contents container and contents rack packed in phase change material.

Turning to FIG. 2, there is shown a top view of the system 10 with the storage container 12 open. The contents rack 14 and contents container 16 are shown in place for storage and/or shipment with loose phase change material 32 packed in the storage area 22 between the contents sleeve 26 and the walls 20. In this example the stabilizers 30 divide the storage area into two smaller regions 34 which may each be at least partially filled with phase change material 32. More stabilizers 30 may be included to further divide the storage area 22 into smaller individual regions 34 to keep the solid phase change material evenly distributed around the contents sleeve 26 even after it begins to change phases.

The stabilizers 30 space the contents sleeve 26, and thus the contents container 16, away from the wall(s) 20 of the storage container 12 at a fixed location. In this example, the stabilizers 30 extend between the contents sleeve 26 and corners of the storage container 12, formed at the intersection of vertical walls 20 of the storage container. The sleeve 26 and stabilizers 30 can be formed and/or assembled as a single unit for removable placement inside the storage area 22 of the container 12. Or the sleeve 26 and the stabilizers 30 can be constructed as separate pieces for individual placement inside the storage area 22. For example, the sleeve 26 may be selected to fit the particular contents container 16 to be stored, and the stabilizers 30 may be separately selected to fit between the sleeve and the walls 20 of the particular storage container 12 to be used.

Selecting from different sizes of stabilizers 30 depending on the size of the storage area 22 is one way of making the stabilizers 30 adjustable. The stabilizers 30 may be made adjustable to fit a given storage area 22 in other manners as well. For example, the stabilizers 30 may be formed from sufficiently foldable or flexible materials that can be bent to fit a given storage area. Or the stabilizers 30 may include sliding or telescoping components. The illustrated stabilizers 30 are in the form of fins that generally extend along the full length of the sleeve 26 (in the vertical direction of FIG. 1). However, the stabilizers 30 need not extend along the full length of the sleeve, and they may assume other forms, such as rods, pins, tubes, planks, or other forms. In another embodiment, the size of the storage area 22 is configured to be variable. For instance, additional panels may be placed in the storage container to effectively increase the thickness of the walls 20 and decrease the size of the storage area 22 to fit a given contents rack 14.

Figure 3:
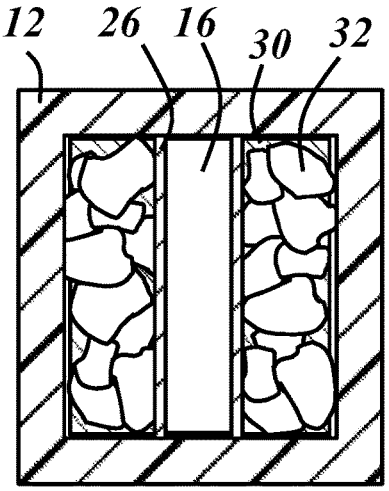
FIG. 3 is a cross-sectional view of the storage system of FIG. 1, with the contents container packed in phase change material.
Figure 4:
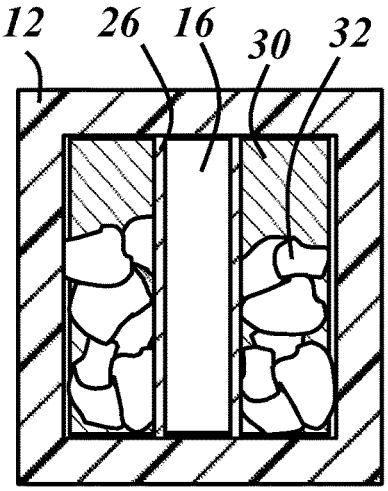
FIG. 4 is the cross-sectional view of FIG. 3 after some of the phase change material has changed phase.
Figure 5:
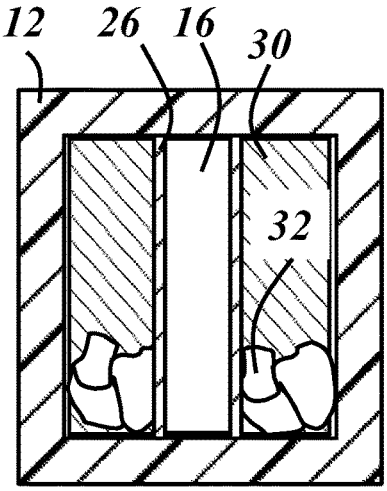
FIG. 5 is the cross-sectional view of FIG. 4 after some more of the phase change material has changed phase.

The contents stabilizers 30 may additionally function as thermal stabilizers. For example, the stabilizers 30 can be constructed from or comprise a metallic material or some other sufficiently thermally conductive material and arranged to form a thermally conductive path between the contents container and phase change material 32 located in the storage area 22 away from the contents container 16. In other words, phase change material 32 such as crushed ice or dry ice that would otherwise not be contacting the contents container 16 or the contents sleeve 26 is placed in conductive thermal communication with the contents container by the conductive stabilizers 30. Thus, as depicted in the cross-sectional views of FIGS. 3-5, which progressively show the phase change material 32 subliming, the conductive path between the contents container 16 and the phase change material is not interrupted. It may be desirable that the stabilizers are shaped to extend completely between the contents sleeve 26 and the storage container walls at least at the bottom of the storage container 12 since the last remaining solid phase change material 32 will settle there. This is true for solid-to-liquid phase change material as well, as the liquid/ice mixture will settle to the bottom of the storage container. Suitable metallic materials for the stabilizers 30 and/or the contents sleeve 26 include copper, aluminum, or their respective alloys. Sheet metal or any other conductive material may also be suitable.

In the above-described manner, the contents rack 14 can both maintain the desired position of the contents container 16 during storage and/or shipment and maintain a conductive thermal path between shifting phase change material 32 and the contents container 16. This can help prevent the stored contents from being subjected to a "floating" phenomenon, especially during shipping, where the storage container 12 may be moved and jostled in multiple directions as it traverses conveyor belts, travels over rough roads, and is manually tossed or thrown by shipping personnel from one location to another. The contents rack can be configured to keep the remaining solid phase change material evenly distributed around the stored contents and in conductive thermal communication with the stored contents, even as the storage container is tossed and turned. Studies have indicated that a typical package in-transit will be rotated 21 times per day. Studies have also indicated that stored contents that have "floated" to the top of a bed of dry ice inside an insulated storage container (in the absence of the contents rack described herein) will warm to temperatures ranging from −20° C. to −30° C.—i.e., about 50° C. or more away from the actual dry ice temperature. Some frozen biomaterials may be critically damaged if they reach such temperatures as a result of floating.

Experiments with an embodiment of the above-described thermal storage system, including a contents rack with stabilizers, have demonstrated that the stored contents can be successfully maintained at the dry ice phase change temperature, even with only 20% of the open storage area filled with dry ice. In comparison, stored contents packed in the same insulated storage container in the absence of the contents rack can reach temperatures of −30° C. or higher when 20% of the open storage area is packed with dry ice.

Figure 6:
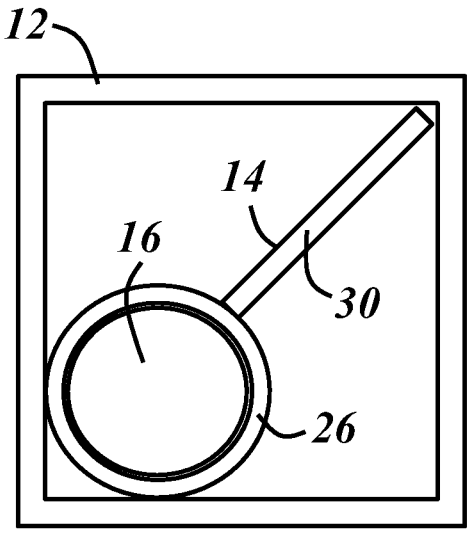
FIG. 6 is a schematic top view of another embodiment of the thermal storage system, where the contents rack includes an off-center contents sleeve.
Figure 7:
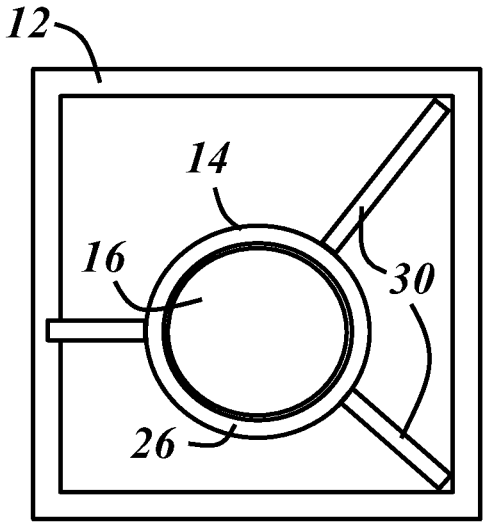
FIG. 7 is a schematic top view of another embodiment of the thermal storage system, where the contents rack is asymmetric.

FIGS. 1-5 illustrate only one configuration of the thermal storage system 10. FIGS. 6-9 schematically show other illustrative configurations. While the contents rack 14 of FIGS. 1-5 is configured to generally center the contents container 16 within the storage area 22, it may also be configured to position the contents container in an off-center location, as shown in FIG. 6. Stabilizer 30 positioning may be asymmetric as well, as shown in FIG. 7.

Figure 8:
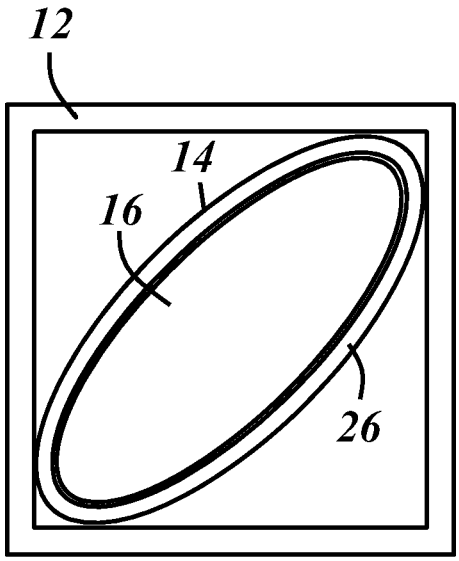
FIG. 8 is a schematic top view of another embodiment of the thermal storage system, where the contents sleeve interacts with walls of the storage container.

In another embodiment, shown in FIG. 8, the contents rack 14 interacts with the walls of the storage container 12 without stabilizers extending from the contents sleeve 26. In this example, the contents sleeve 26 is sized to fit the contents container 16 inside the sleeve and to contact the container walls at the outside of the sleeve, thus stabilizing the position of the contents container and providing a conductive path at least along the length of the metallic sleeve.

Figure 9:
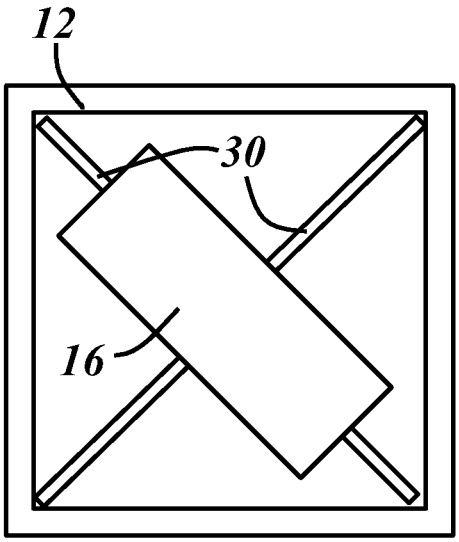
FIG. 9 is a schematic top view of another embodiment of the thermal storage system, where the contents rack includes stabilizers but no contents sleeve.

In another embodiment, shown in FIG. 9, the contents rack consists of stabilizers 30 alone. In this example, metallic fins 30 are placed between the contents container 16 and the walls of the storage container 12 to stabilize the position of the contents container and provide a conductive path between the contents container and phase change material located away from the contents container. The fins 30 may be part of the storage container or they may be individual pieces placed in the storage container after the contents container is in place.

Other variations are possible. For example, the ends of the contents sleeve may be closed-off during storage, the contents rack may include multiple contents sleeves, or the ends of the contents sleeve may be oriented vertically rather than horizontally. In addition, while described in the context of maintaining stored contents at typical cold storage temperatures (0° C. for wet ice or −78.5° C. for dry ice), these teachings are applicable to storage at any temperature. For example, a liquid or molten phase change material could be used to keep stored contents warmer than the external environment, eventually solidifying as is cools. The above-described contents rack could function to maintain a conductive path in such cases, even with the storage area only partially filled.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A thermal storage system, comprising:

a thermally insulated storage container comprising one or more walls that together at least partially define a storage area;

a contents container comprising one or more walls extending between opposite first and second ends; and a contents rack comprising a contents sleeve shaped to make surface contact with substantially an entire surface of each one of the one or more walls of the contents container, wherein the contents rack is configured to interact with at least one of the walls of the thermally insulated storage container to help stabilize the contents container in a desired position within the storage area, wherein the contents rack is removable from the storage container so that another contents rack can be removably placed in the storage area, and wherein the contents rack is removable from a closable end of the storage container, the storage system further comprising a solid phase change material in a portion of the storage area between the sleeve and the one or more walls of the thermally insulated container, said portion of the storage area being accessible from the closable end of the storage container when the contents rack is in the storage area.

2. A thermal storage system as defined in claim 1, wherein the contents rack further comprises a contents stabilizer extending from the contents sleeve, the stabilizer being configured to interact with said at least one of the walls of the thermally insulated storage container to help stabilize the contents container at said desired position within the storage area.

3. A thermal storage system as defined in claim 2, wherein the stabilizer extends between the contents sleeve and a vertical wall of the storage container so that the sleeve is spaced away from said vertical wall and horizontal movement of the contents sleeve with respect to the vertical wall is prevented.

4. A thermal storage system as defined in claim 2, wherein the contents sleeve and the stabilizer are constructed together for placement inside the storage area as one piece.

5. A thermal storage system as defined in claim 2, wherein the contents sleeve and the stabilizer are constructed as separate pieces for individual placement inside the storage area.

6. A thermal storage system as defined in claim 2, wherein the stabilizer is adjustable to extend from the contents sleeve a variable amount.

7. A thermal storage system as defined in claim 2, wherein the stabilizer is a metallic fin.

8. A thermal storage system as defined in claim 1, wherein the storage area has an adjustable size.

9. A thermal storage system as defined in claim 1, wherein the contents rack comprises a metallic material.

10. A thermal storage system as defined in claim 1, wherein the solid phase change material is dry ice.

11. A thermal storage system as defined in claim 1, wherein the contents rack is configured so that the contents sleeve is symmetrically arranged at said desired position in the storage area when viewed from the closable end of the container.

12. A thermal storage system as defined in claim 1, wherein the contents rack is configured so that the contents sleeve is non-symmetrically arranged at said desired position in the storage area when viewed from the closable end of the container.

13. A thermal storage system as defined in claim 1, wherein the contents container is made from a thermoplastic material.

14. A thermal storage system as defined in claim 1, wherein an internal volume of the contents container between the opposite ends of the contents container and circumscribed by the one or more walls of the contents container is divided into a plurality of individual compartments configured to hold a corresponding plurality of individual vials that can be individually retrieved from their respective compartments.

15. A thermal storage system, comprising:

a thermally insulated storage container comprising one or more walls that together at least partially define a storage area;

a contents container sized to fit within the storage area and comprising one or more walls extending between opposite first and second ends;

a contents sleeve sized to be nearly adjacent with substantially an entire surface of each one of the one or more walls of the contents container; and a contents stabilizer in the form of a metallic fin having opposite metallic surfaces facing away from each other in the storage area to form a thermally conductive path between the contents container and phase change material located in the storage area away from the contents container and in contact with both of the opposite metallic surfaces of the stabilizer, wherein the metallic fin extends between and is in contact with the contents sleeve and a vertical wall of the storage container so that the sleeve is spaced away from said vertical wall, and wherein the metallic fin extends vertically along a full length of the sleeve.

16. A thermal storage system as defined in claim 15, further comprising a thin liner for placement between the contents container and the contents sleeve.

17. A thermal storage system as defined in claim 15, wherein the contents stabilizer extends completely between the contents sleeve and the vertical wall of the storage container at a bottom of the storage area.

18. A thermal storage system, comprising:

a thermally insulated storage container comprising one or more walls that together define a closable storage area; and a contents rack comprising:

a contents sleeve shaped to fit around and contain a contents container; and a stabilizer extending from the contents sleeve to secure the contents sleeve in a desired position within a storage area of the storage container and to maintain the contents sleeve in the same desired position within the storage area when the storage area is closed and an orientation of the thermally insulated container is changed from any possible orientation to any other possible orientation, whether or not the contents container is located in the contents sleeve, wherein the stabilizer extends away from the contents sleeve and is in contact with said one or more walls of the thermally insulated container to secure and maintain the contents sleeve in said desired position within the storage area, and wherein the stabilizer is metallic and provides a thermally conductive path extending from the contents rack to said one or more walls with which the stabilizer is in contact such that, when the entire storage area surrounding the contents rack is filled with a loose phase change material in solid form, physical contact between the phase change material and the stabilizer is maintained in all possible orientations of the thermally insulated storage container.

19. A thermal storage system as defined in claim 18, wherein the phase change material is located in a portion of the storage area between the contents sleeve and the one or more walls of the thermally insulated container, said portion of the storage area being accessible from an end of the storage area that is closable.

20. A thermal storage system as defined in claim 18, wherein the contents rack is sheet metal.

* * * * *